United States Patent [19]

Burny, Jr.

[11] Patent Number: 4,554,885

[45] Date of Patent: Nov. 26, 1985

[54] ROTATABLE FLAG SUPPORT

[76] Inventor: Camille J. Burny, Jr., 706 Waukegan Rd., Suite 7C, Glenview, Ill. 60025

[21] Appl. No.: 660,649

[22] Filed: Oct. 15, 1984

[51] Int. Cl.[4] ..... G09F 17/00

[52] U.S. Cl. ..... 116/174

[58] Field of Search ..... 116/173, 174, 175; 52/720, 721, 736, 40, 146; 248/511, 512, 513, 521

[56] References Cited

U.S. PATENT DOCUMENTS

| | | | |
|---|---|---|---|
| 756,989 | 4/1904 | Suhr | 116/174 |
| 1,061,041 | 5/1913 | Buckley | 116/174 |
| 1,295,274 | 2/1919 | Crichton | 116/174 |
| 1,306,915 | 6/1919 | Klamroth | 116/174 |
| 2,368,783 | 2/1945 | Schillinger | 116/174 |
| 2,853,046 | 9/1958 | Meade | 116/173 |
| 2,870,559 | 1/1959 | Shaughnessy | 116/173 |
| 3,595,202 | 7/1971 | Visitacion | 116/174 |

*Primary Examiner*—Charles Frankfort
*Assistant Examiner*—Patrick R. Scanlon
*Attorney, Agent, or Firm*—Emrich & Dithmar

[57] ABSTRACT

A flag support assembly coupled to a halyard/pulley combination secured to an upper portion of a flagstaff for raising and lowering a flag includes a pivoting member which is free to rotate about the flagstaff so as to maintain the flag downwind relative to the flagstaff and in an unfouled, unfurled condition. With the flag fully raised, the pivoting member extends above the top of the flagstaff and may be rotated by wind direction changes about a vertical axis clear of the flagstaff. With the flagstaff positioned downwind of the halyard/pulley combination, the pivoting member extends over and straddles the flagstaff so as to maintain the flag downwind with respect thereto. The lower end of the flag support assembly is coupled to the halyard by means of an elastic or tension member which permits the tension applied to the support assembly to be varied in a controlled manner. With the flag in the fully raised position, the elastic member is stretched so as to apply increased tension to the support assembly which is then maintained in a generally vertical orientation together with the flag coupled thereto. In order to raise and lower the flag, reduced tension is applied to the support assembly by allowing the elastic member to contract to permit the top-heavy support assembly to assume an inclined orientation wherein it is positioned clear of the flagstaff and may be moved upward or downward on the flagstaff.

13 Claims, 5 Drawing Figures

ROTATABLE FLAG SUPPORT

BACKGROUND OF THE INVENTION

This invention relates generally to flag support structures and is particularly directed to an arrangement for raising and lowering a flag on a flagstaff and for maintaining the flag in an unfurled, unfouled condition in the fully upraised position.

In flying a flag it is desirable to maintain the flag in an unfurled condition and to prevent it from becoming entangled with either the flagstaff or supporting lines to which it is attached. Such entanglement of the flag is not only unsightly, but also results in excessive wear and possible damage to the flag and supporting line, or halyard. In addition, an entangled flag may produce excessive strain on the flagstaff in high wind conditions creating a hazard to those in the vicinity of the flagstaff.

The prior art discloses various approaches for supporting a flag from a flagstaff in an unfurled, disentangled condition. These approaches are generally characterized as being overly complicated and not entirely fail-safe. Examples of prior art approaches in this area can be found in U.S. Pat. No. 3,595,202 to Visitacion, U.S. Pat. No. 1,306,915 to Klamroth, U.S. Pat. No. 1,295,274 to Crichton and U.S. Pat. No. 756,989 to Suhr. All of these patents generally include a pair of rings or bearing structures which are positioned in spaced relation along the flagstaff and may be displaced therealong. A halyard is coupled to each of the rings or bearing structures for supporting a flag which is free to rotate about the flagstaff as wind direction changes. The various approaches disclosed in these patents generally include numerous components, are overly complicated, and appear to be commercially unattractive. U.S. Pat. No. 1,061,041 to Buckley discloses another approach involving a rotatable structure mounted to the top of the flagstaff by means of bearings and including a pulley on a lateral portion thereof for supporting the halyard to which the flag is coupled in providing for the raising and lowering of the flag. This arrangement provides only for the rotational displacement of the upper portion of the supporting halyard with wind direction changes and thus would be subject to excessive halyard wear and possible entanglement of the halyard with the flagstaff.

The present invention is intended to overcome the aforementioned limitations of the prior art by providing an inexpensive and effective arrangement for raising and lowering a flag on a flagstaff and for supporting the flag in the fully upraised position which eliminates flag entanglement with either the flagstaff or the halyard as wind direction changes and thus maintains the flag in a fully unfurled condition. The rotatable flag support of the present invention is fully compatible with existing flagstaff configurations and reduces wear upon the flag and supporting halyard and the possibility of damage thereto.

OBJECTS OF THE INVENTION

Accordingly, it is an object of the present invention to provide an improved arrangement for suspending a flag from a flagstaff.

It is another object of the present invention to maintain a flag in an unfurled and unfouled condition when raised on a flagstaff.

Yet another object of the present invention is to provide an improved flag support structure which is fully compatible with existing flagstaff installations and requires no modification thereof.

A further object of the present invention is to provide an improved arrangement for raising and lowering a flag on a flagstaff which is capable of maintaining a fully raised flag free from entanglement with either the flagstaff or the flag halyard.

A still further object of the present invention is to provide an improved flag support arrangement for suspending a flag from a flagstaff which includes only one movable element.

Another object of the present invention is to provide a flag support mechanism which is strong and durable and is thus capable of withstanding high winds with minimal wear on the flag, the halyard and the flag support mechanism itself.

These and other objects are accomplished by the present invention which contemplates a rotatable flag support apparatus for coupling to a flag and to a halyard for raising and lowering the flag on a flagstaff. The flag support apparatus includes an elongated member coupled to a halyard which is supported by a pulley mounted to an upper portion of the flagstaff. The flag support apparatus further includes an offset sleeve coupled to the elongated member which is adapted to receive and pivotally support an inverted, generally U-shaped pivot arm. The pivot arm extends above the top of the flagstaff and is thus free to pivot around the flagstaff which changes in wind direction in maintaining the flag downwind relative to the flagstaff and the pulley/-halyard combination. The flag is thus always positioned away from its supporting structure and cannot become entangled therewith so as to remain in an unfurled condition.

The elongated member of the flag support apparatus is coupled to the halyard by means of an elastic or stretchable member which permits the tension applied to the halyard to be varied in a controlled manner. With the flag in the fully upraised position, the halyard is pulled tight and increased tension is applied to the flag support apparatus which is thus maintained in a generally vertical orientation. With a decrease in tension applied to the elastic member, the top-heavy flag support apparatus assumes an inclined orientation so as to clear the flagstaff permitting the flag to be raised and lowered.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
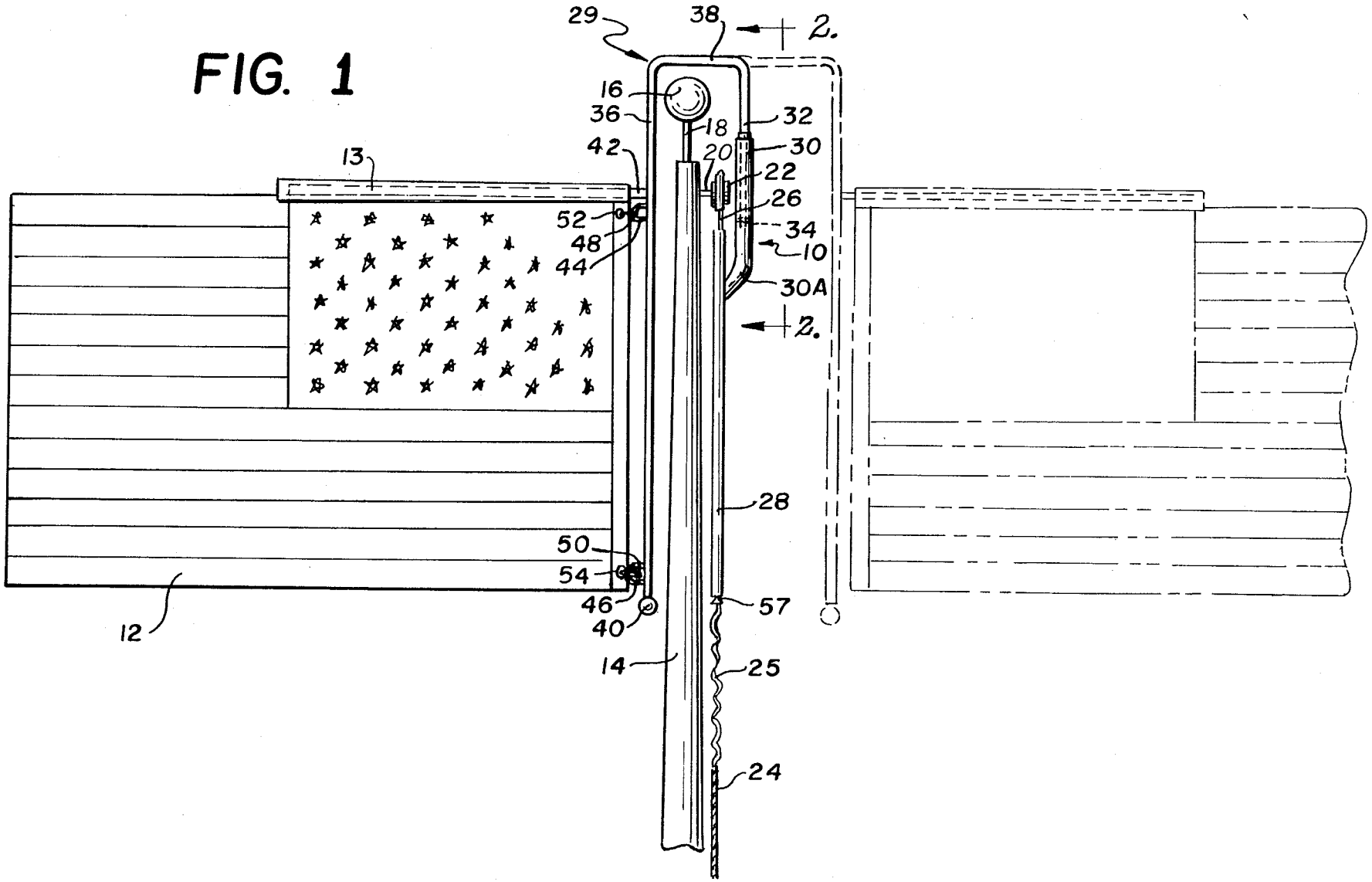
FIG. 1 is a side view of a rotatable flag support in accordance with the present invention in position adjacent the upper end of a flagstaff with the flag in the fully upraised position wherein is illustrated the pivoting nature of the rotatable flag support with changes in wind direction.

Referring to FIG. 1, there is shown a side view of a flag 12 suspended from a flagstaff 14 by means of a rotatable flag support 10 in accordance with the present invention. In FIG. 1, the rotatable flag support 10 and the flag 12 are shown in a first position in solid line form and in a second position in dotted line form to illustrate the manner in which the rotatable flag support 10 rotates about the flagstaff 14 in always maintaining the flag downwind relative to the flagstaff 14.

The flagstaff 14 is oriented in a generally vertical direction and has mounted to the upper end thereof the combination of a ball 16 and support rod 18. Also mounted adjacent to the upper end of the flagstaff 14 by means of a support arm 20 is a rotatable pulley 22 by means of which the halyard which supports the flag 12 may be displaced upward or downward in raising and lowering the flag.

Figure 2:
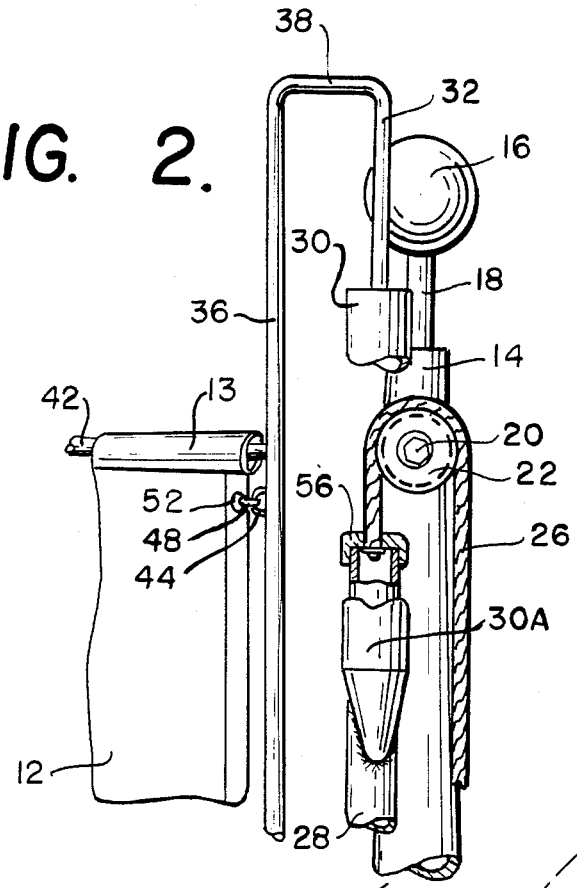
FIG. 2 is a sectional view of the rotatable flag support of FIG. 1 taken along sight line 2—2 therein.

Referring to FIG. 1 and FIG. 2, which is a sectional view of the rotatable flag support arrangement of FIG. 1 taken along sight line 2—2 therein, the configuration and operation of the rotatable flag support 10 of the present invention will now be described in detail. The rotatable flag support 10 is comprised of an elongated coupling section 28, an offset pivot arm sleeve generally in the form of a tube 30, and a pivot arm 29. The elongated coupling section 28 of the rotatable flag support 10 is securely coupled at an upper end thereof to an upper halyard section 26, while the lower end portion of the elongated coupling section 28 is coupled to a lower halyard section 24 by means of a tension coupler 25. The tension coupler 25 is generally comprised of a stretchable or elastic material such as rubber and permits the tension applied to the rotatable flag support 10 to be varied as desired by pulling on either the lower or upper halyard sections 24, 26 to effect increased separation therebetween. Increased tension is applied to the rotatable flag support 10 by means of the tension coupler 25 when the flag 12 is in the fully upraised position in order to align the rotatable flag support 10 generally along the length of the flagstaff 14 in a vertical orientation. A reduced tension is applied to the rotatable flag support 10 by means of the tension coupler 25 during the raising and lowering of the flag 12 as described below.

The upper and lower end portions of the elongated coupling section 28 of the rotatable flag support 10 are provided with suitable coupling means for attaching the elongated coupling section 28 to the upper and lower halyard sections 26, 24. For example, each end of the elongated coupling section 28 may be provided with a cap 56 securely attached thereto through which a section of the halyard is inserted and to which it is securely attached as shown in detail in FIG. 2. The lower end of the elongated coupling section 28 could be provided with a similar or equivalent halyard coupling arrangement shown as element 57 in FIG. 1. The upper halyard section 26 is positioned upon the pulley 22 which is rotatably coupled to the flagstaff mounted support arm 20. Displacement of the upper halyard section 26 over the pulley 22 causes the flag 12 to be raised or lowered upon the flagstaff 14.

The offset pivot arm sleeve 30 of the rotatable flag support 10 is coupled to a lateral portion of the elongated coupling section 28 along the length thereof. The pivot arm sleeve 30 may be integral with the elongated coupling section 28 or may be securely attached thereto such as by welding or other suitable attachment means. The offset pivot arm sleeve 30 is aligned generally with the elongated coupling section 28 and parallels the flagstaff 14 when the flag 12 is in the fully upraised position. The lower end of the offset pivot arm sleeve 30 includes an angled portion 30A connected to the elongated coupling section 28. The upper portion of the offset pivot arm sleeve 30 has a generally tubular shape and has positioned therein a pivot arm stop 34 along the inner length thereof. The pivot arm stop 34 serves as a support bearing for the pivot arm 29 as described below.

The pivot arm 29 is comprised of first, second and third pivot arm sections 32, 36 and 38. The first and second pivot arm sections are aligned generally parallel and are coupled by means of the third pivot arm section 38 at respective upper ends thereof. The second pivot arm section 36 is substantially longer than the first pivot arm section 32 and the length of the third pivot arm section 38 is such as to permit the first and second pivot arm sections 32, 36 to be positioned on opposite sides of the flagstaff 14 when the flagstaff is downwind of the pulley and halyard combination coupled thereto. The first pivot arm section 32 is adapted for insertion within the open, upper end of the offset pivot arm sleeve 30 and is free to rotate therein. The lower end of the first pivot arm section 32 is positioned in abutting contact with the pivot arm stop 34 within the offset pivot arm sleeve 30 which serves as a supporting bearing for facilitating the rotation of the pivot arm 29 about the flagstaff 14.

The second pivot arm section 36 has coupled thereto a horizontal flag support 42 as well as upper and lower mounting loops 44, 46. The horizontal flag support 42 is adapted for insertion within a flag sleeve 13 in the upper edge portion of the flag 12 for maintaining the flag in an extended, unfurled configuration at least over a portion of the length thereof. The horizontal flag support 42 may be either integral with the pivot arm 29 or may be securely coupled to the second section 36 thereof by conventional means. Positioned along the length of the second section 36 of the pivot arm 29 are upper and lower mounting loops 44, 46. A lateral edge portion of the flag 12 is provided with corresponding upper and lower apertures 52, 54 through which are inserted respective upper and lower clips 48, 50 for securely attaching the flag to the upper and lower mounting loops 44, 46 of the pivot arm 29. The lower end portion of the second section 36 of the pivot arm 29 is provided with a pivot arm bumper 40 in the form of a ball, or sphere. The pivot arm bumper 40 contacts the flagpole 14 as the wind velocity and direction change. In this manner, wear upon the rotatable flag support 10 and noise arising from contact of the rotatable flag support with the flagstaff under the influence of the wind is substantially reduced. As shown in dotted line form in FIG. 1, as the wind direction changes so as to be directed from left to right in the figure, the pivot arm 29 pivots about a generally vertical axis defined along the length of the offset pivot arm sleeve 30 of the rotatable flag support 10 so as to rotationally displace the flag 12 about the flagstaff 14 and maintain it clear of the flagstaff.

Figure 3:
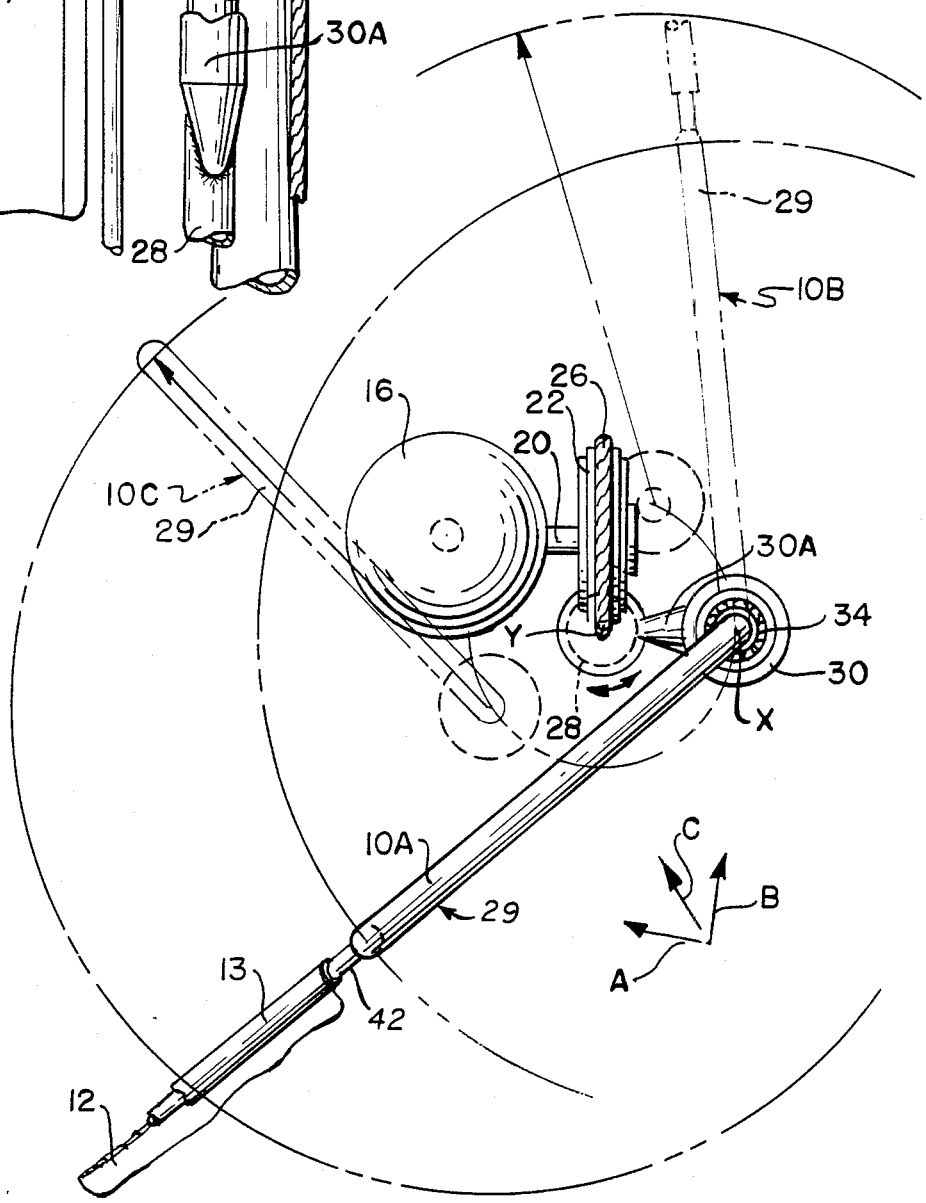
FIG. 3 is a top view of the rotatable flag support of FIG. 1 showing the relative position of components thereof with changes in wind direction.

Referring to FIG. 3, there is shown a top view of the relative orientation of various components of the rotatable flag support 10 and a flag 12 coupled thereto with changes in wind direction. The rotatable flag support is shown in three different orientations designated generally as 10A, 10B and 10C. The direction of the wind for positioning the rotatable flag support in each of the aforementioned orientations are respectively shown by arrows designated by the letters A, B and C in the figure. Thus, a wind direction corresponding to arrow A in FIG. 3 will cause the rotatable flag support to assume orientation 10A in the figure. From the figure, it can be seen that as the wind direction changes, the pivot arm 29 of the rotatable flag support undergoes a corresponding change in orientation in rotating about a generally vertical axis designated by the letter "X". This axis of rotation coincides with the longitudinal axis of the offset pivot arm sleeve 30. From the figure, it can be seen that as wind direction changes from direction "A" to direction "B", the orientation of the rotatable flag support will change from that indicated by designation 10A to the orientation designated by 10B. Rotation of the pivot arm 29 of the rotatable flag support 10 is made possible by its insertion within the tubular portion of the offset pivot arm sleeve 30 and the support provided by the pivot arm stop 34 positioned within the offset pivot arm sleeve 30.

In addition to the pivot arm 29 rotating about the generally vertical axis designated "X" in FIG. 3 with changes in wind direction, the entire rotatable flag support 10 rotates about an axis designated by the letter "Y" as shown in the figure. The generally vertical "Y" axis is aligned with the halyard 26 and the elongated coupling section 28 of the rotatable flag support 10 to which it is attached. Thus, as shown in the figure, as wind direction changes from direction "A" to direction "C", the orientation of the rotatable flag support will change from the position designated 10A to that designated 10C with the pivot arm 29 rotationally displaced about the "X" axis and the entire rotatable flag support rotationally displaced about the "Y" axis. From the figure, it can also be seen that with the wind blowing from a given direction, the offset pivot arm sleeve 30 or the pivot arm 29 may contact either the flagstaff 14 or the ball 16. This does not prevent the rotatable flag support 10 from maintaining the flag in an unfurled, disentangled configuration since the second pivot arm section 36 is maintained in spaced relation from the flagstaff 14 and the ball 16 as well as from the halyard regardless of wind direction.

Figure 4:
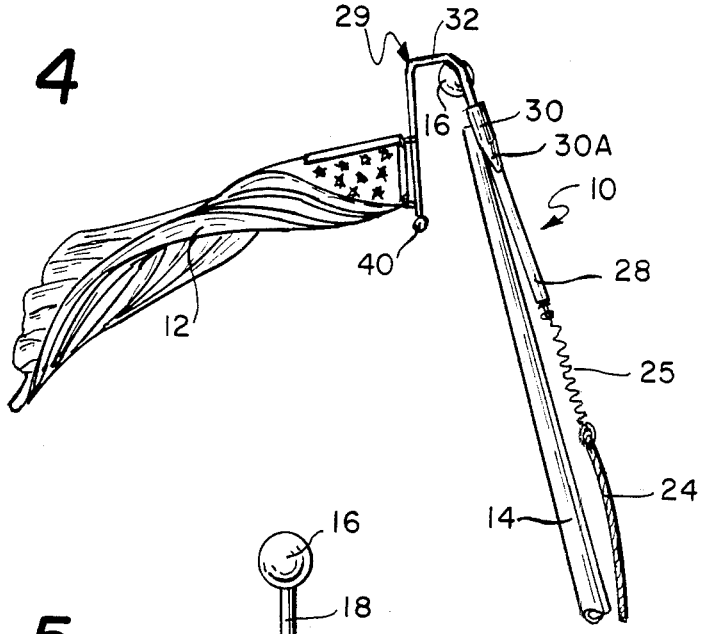
FIG. 4 is a perspective view of a flag in the fully upraised position on a flagstaff wherein the flag is maintained in position by means of a rotatable flag support in accordance with the present invention.

Referring to FIG. 4, there is shown a perspective view of a flag 12 maintained in the fully unraised position on the flagstaff 14 by means of the rotatable flag support 10 of the present invention. From the figure, it can be seen that even if a portion of the rotatable flag support 10 contacts either the flagstaff 14 or the ball 16 positioned on the upper end thereof, the flag 14 will remain in spaced relation from the various aforementioned supporting elements by means of the pivot arm 29.

Figure 5:
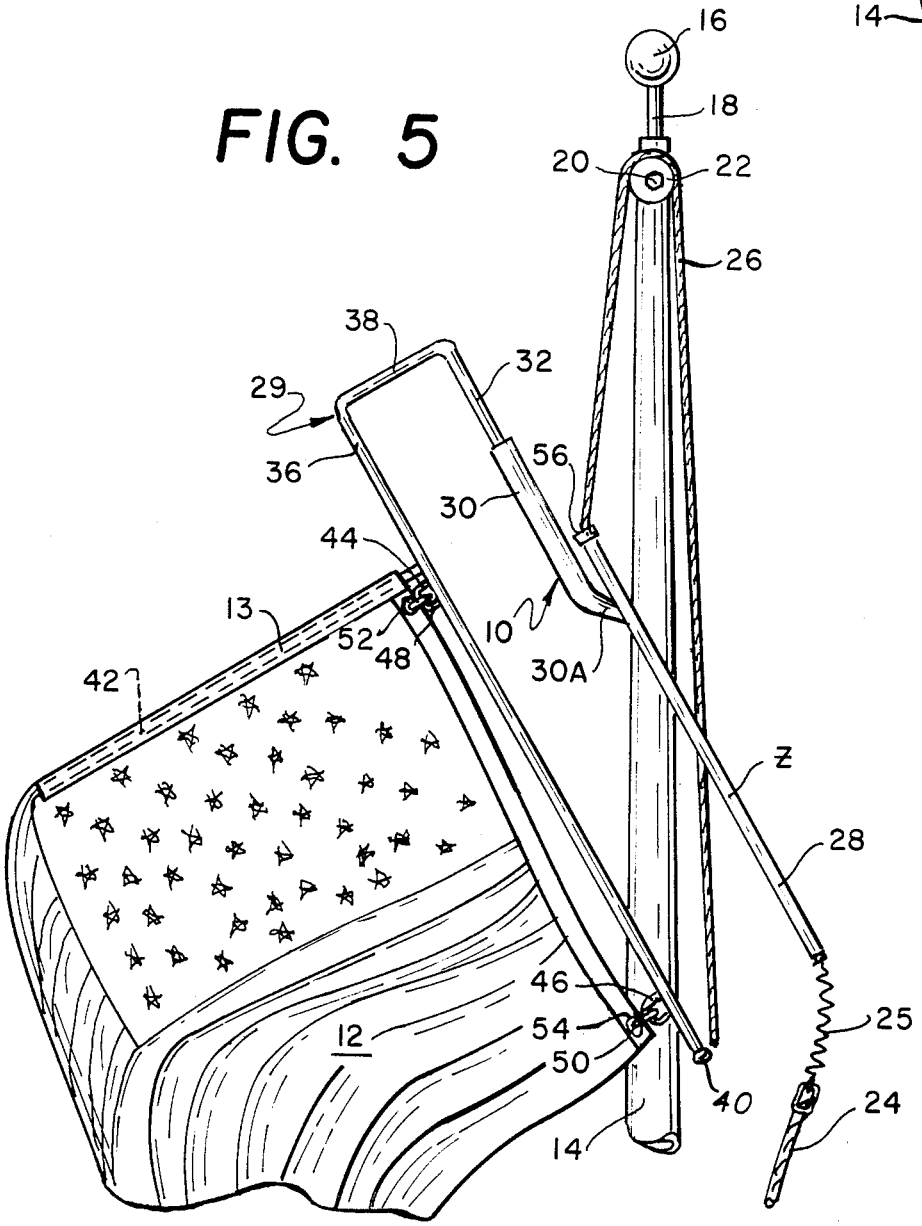
FIG. 5 is a side view of the rotatable flag support of the present invention during the raising or lowering of a flag coupled thereto.

Referring to FIG. 5, there is shown the orientation of the rotatable flag support 10 and a flag 12 coupled thereto during the raising and lowering of the flag upon the flagpole 14. With an expanding force no longer applied to the elastic tension coupler 25 secured to respective ends of the lower halyard section 24 and the elongated coupling section 28, the rotatable flag support 10 is free to rotate about a generally horizontal axis designated by the letter "Z" in the figure. The pivoting re-orientation of the rotatable flag support 10 upon a reduction in or removal of a force applied along the tension coupler 25 arises from the top-heavy weight distribution in the rotatable flag support 10 as well as from the weight of the flag 12 coupled thereto. This pivoting action of the rotatable flag support 10 results in its spaced displacement from the flagstaff 14 and ball 16 and permits the rotatable flag support 10 to be either raised or lowered along the flagstaff 14 without interference therefrom and permits the third pivot arm section 38 of the rotatable flag support 10 to be maintained in spaced relation from the ball 16 to allow the rotatable flag support to clear the ball and facilitate the lowering of the flag 12. It should be noted here that the pivoting axis of the rotatable flag support 10 designated by the letter "Z" in FIG. 5 may be located anywhere along the length of the elongated coupling section 28 depending upon the weight distribution within the rotatable flag support 10 and the weight of the flag 12 coupled thereto. Thus, the location of the pivot axis "Z" is indicated in the figure merely for descriptive purposes and does not represent the actual pivot axis of the rotatable flag support 10 as this would depend upon various of the aforementioned structural and component parameters.

There has thus been shown a rotatable flag support coupled to a halyard and pulley combination which is mounted to a flagstaff for raising and lowering a flag thereon which is capable of maintaining the flag in a disentangled and unfurled condition when in the fully upraised position. The flag is always maintained downwind relative to the flagstaff and flag support assembly and wear upon and damage to the flag and supporting assembly is minimized by the rotatable flag support of the present invention.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Apparatus for supporting a flag on a flagstaff to which is mounted a pulley and halyard combination for raising and lowering the flag, said apparatus comprising:

a coupling member coupled at a first end thereof to a first section of the halyard engaging the pulley;

an offset tubular sleeve coupled to said coupling member;

pivot means coupled to the flag and positioned within said offset tubular sleeve and extending along a portion of the length thereof and freely rotatable therein, said pivot means extending above and adapted to be positioned over the flagstaff with the flag in a fully raised position for maintaining the flag in spaced relation and downwind from the flagstaff; and variable tension means coupling a second end of the coupling member to a second section of the halyard for applying increased tension to the halyard in orienting said pivot means generally vertically with the flag in the fully raised position and for reducing the tension applied to the halyard during the raising and lowering of the flag whereby said pivot means is maintained in spaced, offset relation from the flagstaff.

2. The apparatus of claim 1 wherein said coupling member comprises a linear, elongated member having upper and lower end portions respectively coupled to said first and second halyard sections.

3. The apparatus of claim 1 wherein said offset tubular sleeve is attached to said coupling member along the length thereof intermediate the first and second ends of said coupling member.

4. The apparatus of claim 3 wherein said offset tubular sleeve includes a lower angled portion coupled to said coupling member and an upper open end portion within which is positioned said pivot means.

5. The apparatus of claim 4 wherein the upper portion of said offset tubular sleeve and said coupling member are generally linear and elongated in shape and are aligned generally parallel with each other.

6. The apparatus of claim 4 further including bearing means positioned within said offset tubular sleeve and in abutting contact with said pivot means for supporting and facilitating rotational displacement of said pivot means.

7. The apparatus of claim 1 wherein said pivot means includes first, second and third coupled sections and wherein said first section is positioned within said offset tubular sleeve, said second section is coupled to said flag, and said third section couples said first and second sections at respective end portions thereof.

8. The apparatus of claim 7 wherein said second section includes flag support means for maintaining the flag in an extended, unfurled configuration over at least a portion of the length thereof when the flag is in a fully raised position.

9. The apparatus of claim 7 wherein each of the first, second and third sections of said pivot means is generally linear and elongated in shape and wherein said sections in combination form an inverted U-shaped structure.

10. The apparatus of claim 9 wherein the respective end portions of said third section are coupled to respective upper first end portions of said first and second sections and wherein a second, lower end portion of said first section is positioned within said offset tubular sleeve.

11. The apparatus of claim 10 wherein a second, lower end portion of said second section includes contact means for engaging the flagstaff in reducing wear and noise arising from displacement of said pivot means due to changes in wind velocity.

12. The apparatus of claim 11 further comprising coupling means positioned along the length of the second section of said pivot means for securing the flag thereto.

13. The apparatus of claim 1 wherein the combination of said coupling member, said offset tubular sleeve and said pivot means is top-heavy for facilitating the displacement of said pivot means away from the flagstaff during the raising and lowering of the flag with reduced tension applied to the halyard.

* * * * *